US006616807B1

(12) United States Patent
Dyllick-Brenzinger et al.

(10) Patent No.: US 6,616,807 B1
(45) Date of Patent: Sep. 9, 2003

(54) METHOD FOR PRODUCING HIGH DRY-STRENGTH PAPER, PULPBOARD AND CARDBOARD

(75) Inventors: Rainer Dyllick-Brenzinger, Weinheim (DE); Primoz Lorencak, Ludwigshafen (DE); Hubert Meixner, Ludwigshafen (DE); Peter Baumann, Böhl-Iggelheim (DE); Ellen Krüger, Mannheim (DE); Andreas Stange, Mannheim (DE); Martin Rübenacker, Altrip (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/381,970

(22) PCT Filed: Mar. 26, 1998

(86) PCT No.: PCT/EP98/01786

§ 371 (c)(1),
(2), (4) Date: Oct. 1, 1999

(87) PCT Pub. No.: WO98/45536

PCT Pub. Date: Oct. 15, 1998

(30) Foreign Application Priority Data

Apr. 4, 1997 (DE) ..... 197 13 755

(51) Int. Cl.[7] ..... D21H 21/10; D21H 21/18; D21H 17/29; D21H 17/45; D21H 17/55; D21H 17/56

(52) U.S. Cl. ..... 162/175; 162/164.6; 162/168.3; 162/183

(58) Field of Search ..... 162/168.1–168.6, 162/164.6, 166, 175, 183, 158; 525/340, 344, 355, 374; 526/215, 263, 291, 307.1; 127/32, 71; 210/734; 106/210, 213

(56) References Cited

U.S. PATENT DOCUMENTS 3,734,820 A * 5/1973 Hoover et al. ..... 162/168.3
3,854,970 A * 12/1974 Aitken ..... 106/209.1
4,097,427 A * 6/1978 Aitken et al. ..... 527/312
4,146,515 A * 3/1979 Buikema et al. ..... 524/610
4,421,602 A * 12/1983 Brunnmueller et al. .. 162/168.2
4,818,341 A * 4/1989 Degen et al. ..... 162/168.2
4,835,212 A * 5/1989 Degen et al. ..... 524/734
4,855,343 A * 8/1989 Degen et al. ..... 524/47
4,940,514 A * 7/1990 Stange et al. ..... 162/168.2
4,978,427 A * 12/1990 Pfohl et al. ..... 162/168.2
5,201,998 A * 4/1993 Topfl et al. ..... 162/158
5,262,008 A * 11/1993 Moench et al. ..... 162/168.2
5,338,406 A * 8/1994 Smith ..... 162/168.2
5,382,324 A * 1/1995 Fischer et al. ..... 162/168.2
5,496,440 A * 3/1996 Carré et al. ..... 162/168.3
5,516,852 A * 5/1996 Kuo et al. ..... 525/340
5,700,893 A * 12/1997 Kuo et al. ..... 526/307.1
5,720,888 A * 2/1998 Kuo et al. ..... 210/734
5,942,087 A * 8/1999 Pruszynski ..... 162/175
6,132,558 A * 10/2000 Dyllick-Brenzinger et al. .. 162/164.6

FOREIGN PATENT DOCUMENTS

DE 44 38 708 * 5/1996
WO 97/13033 * 4/1997
WO 98/48112 * 10/1998

* cited by examiner

*Primary Examiner*—Jose A. Fortuna
(74) *Attorney, Agent, or Firm*—Oblon, Spivak, McClelland, Maier & Neustadt, P.C.

(57) ABSTRACT

Paper, board and cardboard having high dry strength are produced by the addition of cationic, anionic and/or amphoteric starch as dry strength agents to the paper stock and drainage of the paper stock with sheet formation in the presence of cationic polymers as retention aids for starch, and cationic polymeric retention aids are used for increasing the retention of dry strength agents comprising cationic, anionic and/or amphoteric starch in the production of paper, board and cardboard.

18 Claims, No Drawings

METHOD FOR PRODUCING HIGH DRY-STRENGTH PAPER, PULPBOARD AND CARDBOARD

BACKGROUND OF THE INVENTION

1. Field of The Invention

The present invention relates to a process for the production of paper, board and cardboard having high dry strength by the addition of cationic, anionic and/or amphoteric starch as a dry strength agent to the paper stock and drainage of the paper stock with sheet formation.

2. Description of The Background

For increasing the dry strength of paper, for example, Ullmanns Encyklopädie der technischen Chemie, 4th edition, Verlag Chemie, Weinheim-New York, 1979, volume 17, page 581, discloses the use of aqueous suspensions of natural starches, which are converted into water-soluble form by heating, as a pulp additive in paper making. However, the retention of the starches dissolved in water by the paper fibers in the paper stock is low. An improvement in the retention of natural products by cellulose fibers in paper making is disclosed, for example, in U.S. Pat. No. 3,734,820. Said publication describes graft copolymers which are prepared by grafting dextran, a naturally occurring polymer having a molecular weight of from 20,000 to 50 million, with cationic monomers, e.g. diallyldimethylammonium chloride, mixtures of diallyldimethylammonium chloride and acrylamide or mixtures of acrylamide and basic methacrylates, such as dimethylaminoethyl methacrylate. The graft polymerization is preferably carried out in the presence of a redox catalyst.

U.S. Pat. No. 4,097,427 discloses a process for the cationization of starch, in which the starch digestion is carried out in an alkaline medium in the presence of water-soluble quaternary ammonium polymers and an oxidizing agent. Suitable quaternary ammonium polymers include quaternized diallyldialkylamino polymers or quaternized polyethyleneimines. Oxidizing agents are, for example, ammonium persulfate, hydrogen peroxide, sodium hypochlorite, ozone or tert-butyl hydroperoxide. The modified cationic starches which can be prepared in this manner are added to the paper stock as dry strength agents in paper making. However, the wastewater has a very high COD (chemical oxygen demand).

U.S. Pat. No. 4,146,515 discloses a process for the preparation of cationic starch which is used for surface sizing and coating of paper and paper products. According to this process, an aqueous suspension of oxidized starch is digested together with a cationic polymer in a continuous digester. Suitable cationic polymers are condensates of epichlorohydrin and dimethylamine, polymers of diallyldimethylammonium chloride, quaternized reaction products of ethylene chloride and ammonia and quaternized polyethyleneimine.

U.S. Pat. No. 3,467,608 discloses a process for the preparation of a cationic starch, in which a suspension of starch in water is heated for from about 0.5 to 5 hours at from about 70 to 110° C. together with a polyalkyleneimine or polyalkylenepolyamine having a molecular weight of at least 50,000. The mixture contains from 0.5 to 40% by weight of polyalkyleneimine or polyalkylenepolyamine and from 99.5 to 60% by weight of starch. According to Example 1, a polyethyleneimine having an average molecular weight of about 200,000 is heated in dilute aqueous solution with potato starch for 2 hours at 90° C. The modified potato starch can be precipitated in a mixture of methanol and diethyl ether. The reaction products of starch and polyethyleneimine or polyalkylenepolyamines, described in U.S. Pat. No. 3,467,608, are used as flocculants.

EP-A-0 282 761 and DE-A-3 719 480 disclose production processes for paper, board and cardboard having high dry strength. In this process [sic], the dry strength agents used are reaction products which are obtainable by heating natural potato starch with cationic polymers, such as polymers or polyethyleneimines containing vinylamine, N-vinylimidazoline or diallyldimethylammonium units in an aqueous medium at temperatures above the glutinization temperature of the starch in the absence of oxidizing agents, polymerization initiators and alkali.

EP-B-0 301 372 discloses just such a process in which appropriately modified enzymatically degraded starches are used. Under the digestion conditions stated there for natural starch, a relatively large amount of degradation products (degradation rates>10%) is also found in addition to incomplete digestion (spectroscopic investigations indicate undissolved, in some cases only partially swollen starch grains).

U.S. Pat. No. 4,880,497 and U.S. Pat. No. 4,978,427 disclose a process for the production of paper having high dry and wet strength, in which a hydrolyzed copolymer which is obtainable by copolymerization of N-vinylformamide and ethylenically unsaturated monomers, for example vinyl acetate, vinyl propionate or alkyl vinyl ethers, and hydrolysis of from 30 to 100 mol % of the formyl groups of the copolymer with formation of amino groups is added as strength agent either to the surface of the paper or the paper stock prior to sheet formation. The hydrolyzed copolymers are used in amounts of from 0.1 to 5% by weight, based on dry fibers.

DE-A-4 127 733 discloses hydrolyzed graft polymers of N-vinylformamide and natural substances containing saccharide structures, which polymers are used as dry and wet strength agents. However, the hydrolysis of the graft polymers under acidic conditions results in a considerable decrease in the molecular weight of the polysaccharides.

WO-A-96/13525 discloses a process for cationic modification of starch by reacting starch with polymers which contain amino and/or ammonium groups in an aqueous medium at from 115 to 180° C. under superatmospheric pressure, not more than 10% by weight of the starch used being degraded.

H. R. Hernandez, describes, in EUCEPA 24$^{th}$ Cont. Proc. Pap. Technol., May 1990, pages 186–195, the use of cationic or amphoteric starches together with cationic or anionic retention aids in papermaking. In one paper machine experiment, papermaking is carried out in the alkali pH range being alkenylsuccinic anhydride, Alun, amphoteric waxy starch and an anionic rfetention aid.

If a cationically modified starch is added as a dry strength agent to the paper stock, an undesirable decrease in the drainage rate of the paper stock occurs. At the same time, an increase in the COD of the waste water of the paper machine is observed. This increase in the COD occurs in particular in the case of paper machine waste water having a high salt content.

It is an object of the present invention to provide a process for the production of paper, board and cardboard having high dry strength, higher retention of starch in the paper and hence a lower COD in the paper machine waste water being achieved and moreover an acceleration of the drainage rate being obtained in comparison with the prior art.

SUMMARY OF THE INVENTION

We have found that this object is achieved, according to the invention, by a process for the production of paper, board and cardboard having high dry strength by the addition of cationic, anionic and/or amphoteric starch as a dry strength agent to the paper stock and drainage of the paper stock in the presence of retention aids with sheet formation, if the following are used as a retention aid for starch.

- polymers containing vinylamine units
- polyethyleneimines
- crosslinked polyamidoamines
- ethyleneimine-grafted and crosslinked polyamidoamines
- polydiallyldimethylammonium chlorides
- polymers containing N-vinylimidazoline units
- polymers containing dialkylaminoalkyl acrylate or dialkylaminoalkyl methacrylate
- polymers containing dialkylaminoalkylacrylamide units or dialkylaminoalkylmethacrylamide units and
- polyallylamines.

The present invention furthermore relates to the use of cationic polymeric retention aids from the group consisting of

- polymers containing vinylamine units
- polyethyleneimines
- crosslinked polyamidoamines
- ethyleneimine-grafted and crosslinked polyamidoamines
- polydiallyldimethylammonium chlorides
- polymers containing N-vinylimidazoline units
- polymers containing dialkylaminoalkyl acrylate or dialkylaminoalkyl methacrylate
- polymers containing dialkylaminoalkylacrylamide units or dialkylaminoalkylmethacrylamide units and
- polyallylamines.

for increasing the retention of dry strength agents comprising cationic, anionic and/or amphoteric starch in the production of paper, board and cardboard. Particularly preferred is the use of hydrolyzed homo- or copolymers of N-vinylformamide having a degree of hydrolysis of from 1 to 100% and a K value of at least 30 (determined by H. Fikentscher in aqueous solution at a polymer concentration of 0.5% by weight, a temperature of 25° C. and a pH of 7) in amounts of from 0.01 to 0.3% by weight, based on dry paper stock, as retention aids of cationic, anionic and/or amphoteric starch.

DETAILED DESCRIPTION OF THE INVENTION

Suitable fibers for the production of the pulps are all qualities conventionally used for this purpose, for example mechanical pulp, bleached and unbleached chemical pulp and paper stocks obtained from all annual plants. Mechanical pulp includes, for example, groundwood, thermomechanical pulp (TMP), chemothermomechanical pulp (CTMP), pressure groundwood, semichemical pulp, high-yield chemical pulp and refiner mechanical pulp (RMP). Examples of suitable chemical pulps are sulfate, sulfite and soda pulps. Suitable annual plants for the preparation of paper stocks are, for example, rice, wheat, sugarcane and kenaf. Wastepaper alone or as a mixture with other fibers is also used for the preparation of the pulps. Wastepaper includes coated waste which, owing to the content of binder for coatings and printing inks, gives rise to white pitch. Adhesives originating from adhesive labels and envelopes and adhesives from the spine glue of books as well as hot melts give rise to the formation of stickies.

The stated fibers can be used alone or as a mixture with one another. The pulps of the abovementioned type contain varying amounts of water-soluble and water-insoluble interfering substances. The interfering substances can be quantitatively determined, for example, with the aid of the COD or with the aid of the cationic demand. Cationic demand is understood as meaning that amount of cationic polymer which is required to bring a defined amount of white water to the isoelectric point. Since the cationic demand depends to a great extent on the composition of the respective cationic polymer used for the determination, a condensate obtained according to Example 3 of DE-B-2 434 816 and obtainable by grafting a polyamidoamine of adipic acid and diethylenetriamine with ethyleneimine and subsequently crosslinking with a polyethylene glycol dichlorohydrin ether is used for standardization. The pulps containing interfering substances have, for example, a COD of from 300 to 40,000, preferably from 1,000 to 30,000, mg of oxygen per kg of the aqueous phase and a cationic demand of more than 50 mg of the stated cationic polymer per liter of white water.

Cationic, anionic and amphoteric starches are known and are commercially available. Cationic starches are prepared, for example, by reacting natural starches with quaternizing agents, such as 2,3-(epoxypropyl)trimethylammonium chloride. Starch and starch derivatives are described in detail, for example, in the book by Günther Tegge, Stärke und Stärkederivate, Behr's-Verlag, Hamburg 1984.

Starches which are obtainable by reacting natural, cationic, anionic and/or amphoteric starch with synthetic cationic polymers are particularly preferably used as dry strength agents. The natural starches used may be, for example, corn starch, potato starch, wheat starch, rice starch, tapioca starch, sago starch, sorghum starch, cassava starch, pea starch, rye starch or mixtures of the stated natural starches. Other suitable starches are ryemeal and other meals. Protein-containing starches from rye, wheat and leguminous plants are also suitable. Those natural starches which have an amylopectin content of at least 95% by weight are also suitable for the cationic modification with polymers. Starches containing at least 99% by weight of amylopectin are preferred. Such starches can be obtained, for example, by starch fractionation of conventional natural starches or by cultivation measures from plants which produce virtually pure amylopectin starch. Starches having an amylopectin content of at least 95, preferably at least 99%, by weight, are commercially available. They are offered, for example, as waxy corn starch, waxy potato starch or waxy wheat starch. The natural starches can be modified either alone or as a mixture with cationic polymers.

The modification of the natural starches and of cationic, anionic and/or amphoteric starch with synthetic cationic polymers is carried out by known processes, by heating starches in an aqueous medium in the presence of cationic polymers at temperatures above the glutinization temperature of the starches. Processes of this type are disclosed, for example, in the publications EP-B-0 282 761 and WO-A-96/13525 mentioned in connection with the prior art. All synthetic polymers which contain amino and/or ammonium groups are suitable for the cationic modification of the abovementioned starches. These compounds are referred to below as cationic polymers.

Examples of suitable cationic polymers are homo- and copolymers containing vinylamine units. Polymers of this type are prepared by known processes, by polymerizing N-vinylcarboxamides of the formula

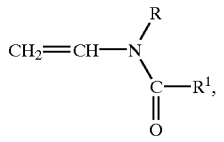

(I)

where R and $R^1$ are identical or different and are each H or $C_1$–$C_6$-alkyl, alone or in the presence of other monomers copolymerizable therewith, and hydrolyzing the resulting polymers with acids or bases with elimination of the group

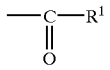

(II)

and with formation of units of the formula

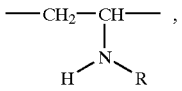

(III)

where R has the meaning stated in the formula (I).

Suitable monomers of formula (I) are, for example, N-vinylformamide, N-vinyl-N-methylformamide, N-vinyl-N-ethylformamide, N-vinyl-N-propylformamide, N-vinyl-N-isopropylformamide, N-vinyl-N-butylformamide, N-vinyl-N-sec-butylformamide, N-vinyl-N-tert-butylformamide, N-vinyl-N-pentylformamide, N-vinylacetamide, N-vinyl-N-ethylacetamide and N-vinyl-N-methylpropionamide. N-vinylformamide is preferably used in the preparation of polymers which contain polymerized units of the formula (III).

The hydrolyzed polymers which contain units of the formula (III) have K values of from 15 to 300, preferably from 30 to 200, determined according to H. Fikentscher in aqueous solution at pH 7, at 25° C. and at a polymer concentration of 0.5% by weight. Copolymers of the monomers (I) contain, for example, 1) from 99 to 1 mol % of N-vinylcarboxamides of the formula (I) and
2) from 1 to 99 mol % of other monoethylenically unsaturated monomers copolymerizable therewith, for example vinyl esters of saturated carboxylic acids of 1 to 6 carbon atoms, e.g. vinyl formate, vinyl acetate, vinyl propionate and vinyl butyrate. Unsaturated $C_3$–$C_6$-carboxylic acids, e.g. acrylic acid, methacrylic acid, maleic acid, crotonic acid, itaconic acid and vinylacetic acid and alkali metal and alkaline earth metal salts, esters, amides and nitriles thereof, for example methyl acrylate, methyl methacrylate, ethyl acrylate and ethyl methacrylate, or with [sic] glycol or polyglycol esters of ethylenically unsaturated carboxylic acids in each case only one OH group of the glycols and polyglycols being esterified, e.g. hydroxyethyl acrylate, hydroxyethyl methacrylate, hydroxypropyl acrylate, hydroxybutyl acrylate, hydroxypropyl methacrylate, hydroxybutyl methacrylate and the acrylic monoesters of polyalkylene glycols having a molecular weight of from 1,500 to 10,000, are also suitable. The esters of ethylenically unsaturated carboxylic acids with amino alcohols, e.g. dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, diethylaminopropyl methacrylate, dimethylaminobutyl acrylate and diethylaminobutyl acrylate are furthermore suitable. The basic acrylates are used in the form of the free bases, of the salts with mineral acids, e.g. hydrochloric acid, sulfuric acid and nitric acid, of the salts with organic acids, such as formic acid or benzenesulfonic acid, or in quaternized form. Suitable quaternizing agents are, for example, dimethyl sulfate, diethyl sulfate, methyl chloride, ethyl chloride and benzyl chloride.

Other suitable comonomers 2) are unsaturated amides, for example acrylamide, methacrylamide and N-alkylmonoamides and N-alkyldiamides having alkyl radicals of 1 to 6 carbon atoms, e.g. N-methylacrylamide, N,N-dimethylacrylamide, N-methylmethacrylamide, N-ethylacrylamide, N-propylacrylamide and tert-butylacrylamide, and basic (meth)acrylamides, e.g. dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Other suitable comonomers are N-vinylpyrrolidone, N-vinylcaprolactam, acrylonitrile, methacrylonitrile, N-vinylimidazole and substituted N-vinylimidazoles, e.g. N-vinyl-2-methylimidazole, N-vinyl-4-methylimidazole,: N-vinyl-5-methylimidazole, N-vinyl-2-ethylimidazole, and N-vinylimidazolines, e.g. vinylimidazoline, N-vinyl-2-methylimidazoline, and N-vinyl-2-ethylimidazoline. In addition to being used in the form of the free bases, N-vinylimidazoles and N-vinylimidazolines are used in a form neutralized with mineral acids or organic acids or in quaternized form, quaternization preferably being effected with dimethyl sulfate, diethyl sulfate, methyl chloride or benzyl chloride.

Other suitable comonomers 2) are sulfo-containing monomers, for example vinylsulfonic acid, allylsulfonic acid, methallylsulfonic acid, styrenesulfonic acid or 3-sulfopropyl acrylate.

When basic comonomers 2), for example, basic acrylates and acrylamides, are used, it is often possible to dispense with hydrolysis of the N-vinylcarboxamides. The copolymers comprise terpolymers and those polymers which additionally contain at least one further monomer as polymerized units.

Preferred cationic polymers are hydrolyzed copolymers of

1) N-vinylformamide and
2) vinyl formate, vinyl acetate, vinylpropionate, acrylonitrile and N-vinylpyrrolidone and hydrolyzed homopolymers of N-vinylformamide having a degree of hydrolysis of from 2 to 100, preferably from 30 to 95, mol %.

In the case of copolymers which contain vinyl esters as polymerized units, hydrolysis of the ester groups with formation of vinyl alcohol units occurs in addition to the hydrolysis of the N-vinylformamide units. Polymerized acrylonitrile is likewise chemically modified in the hydrolysis, for example amido, cyclic amidine and/or carboxyl groups being formed. The hydrolyzed poly-N-vinylformamides can, if required, contain up to 20 mol % of amidine structures which are formed by reaction of formic acid with two neighboring amino groups in the polyvinylamine or by reaction of a formamide group with a neighboring amino group.

Other suitable cationic polymers are compounds containing polymerized ethyleneimine units. These are preferably polyethyleneimines which are obtainable by polymerizing ethyleneimine in the presence of acidic catalysts, such as ammonium hydrogen sulfate, hydrochloric acid or chlorinated hydrocarbons, such as methyl chloride, ethylene chloride, carbon tetrachloride or chloroform. Such polyethyleneimines have, for example in 50% strength by weight aqueous solution, a viscosity of from 500 to 33,000, preferably from 1,000 to 31,000 mPa.s (measured according to Brookfield at 20° C. and 20 rpm). The polymers of this group include polyamidoamines which are grafted with ethyleneimine and may furthermore be crosslinked by reaction with a bifunctional or polyfunctional crosslinking agent. Products of this type are prepared, for example, by condensation of a dicarboxylic acid, such as adipic acid, with a polyalkylene polyamine, such as diethylenetriamine or triethylenetetramine, if necessary grafting with ethyleneimine and reaction with a bifunctional or polyfunctional crosslinking agent, e.g. a bischlorohydrin ether of a polyalkylene glycol, cf. U.S. Pat. No. 4,144,123 and U.S. Pat. No. 3,642,572.

Polydiallyldimethylammonium chlorides are also suitable for starch modification. Polymers of this type are known. Polymers of diallyldimethylammonium chloride are to be understood as meaning primarily homopolymers and copolymers with acrylamide and/or methacrylamide. The copolymerization can be carried out in any desired monomer ratio. The K value of the homo- and copolymers of diallyldimethylammonium chloride is at least 30, preferably from 95 to 180.

Other suitable cationic polymers are homo- and copolymers of unsubstituted or substituted N-vinylimidazolines. These, too, are known substances. They can be prepared, for example, by the process of DE-B-1 182 826, by polymerizing compounds of the formula (IV)

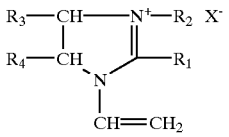

where $R_1$ and $R_2$ are each H, $C_1$–$C_{18}$-alkyl, benzyl or aryl, $R_3$ and $R_4$ are each H or $C_1$–$C_4$-alkyl and $X^-$ is an acid radical, if required together with acrylamide and/or methacrylamide, in an aqueous medium at a pH of from 0 to 8, preferably from 1.0 to 6.8 in the presence of polymerization initiators which decompose into free radicals.

Preferably, 1-vinyl-2-imidazoline salts of the formula (V), (V)

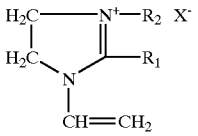

where $R_1$ and $R_2$ are each H, $CH_3$, $C_2H_5$, n- and i-$C_3H_7$, or $C_6H_5$ and $X^-$ is an acid radical, are used in the polymerization. $X^-$ is preferably $Cl^-$, $Br^-$, $SO_4^{2-}$, $CH_3$—O—$SO_3^-$ or R—$COO^-$ and $R_2$ is H, $C_1$–$C_4$-alkyl or aryl.

$X^-$ in the formulae (IV) and (V) may in principle be any desired acid radical of an inorganic or an organic acid. The monomers of the formula (IV) are obtained by neutralizing the free bases, i.e. 1-vinyl-2-imidazolines, with an equivalent amount of an acid. The vinylimidazolines can also be neutralized with, for example, trichloroacetic acid, benzenesulfonic acid or toluenesulfonic acid. In addition to salts of 1-vinyl-2-imidazolines, quaternized 1-vinyl-2-imidazolines are also suitable. They are prepared by reacting 1-vinyl-2-imidazolines which may be unsubstituted or substituted in the 2, 4 and 5 position, with known quaternizing agents. Examples of quaternizing agents are $C_1$–$C_{18}$-alkyl chlorides or bromides, benzyl chloride or bromide, epichlorohydrin, dimethyl sulfate and diethyl sulfate. Epichlorohydrin, benzyl chloride, dimethyl sulfate and methyl chloride are preferably used.

For the preparation of the water-soluble homopolymers, the compounds of the formula (IV) or (V) are preferably polymerized in an aqueous medium.

Since the compounds of the formula (IV) are relatively expensive, copolymers of compounds of the formula (IV) with acrylamide and/or methacrylamide are preferably used as cationic polymers for economic reasons. These copolymers then contain the compounds of the formula (IV) only in effective amounts, i.e. in an amount of from 1 to 50, preferably from 10 to 40%, by weight. Copolymers of from 60 to 85% by weight of acrylamide and/or methacrylamide and from 15 to 40% by weight of N-vinylimidazoline or N-vinyl-2-methylimidazoline are particularly suitable for modifying natural starches. The copolymers may furthermore be modified by incorporating polymerized units of other monomers, such as styrene, N-vinylformamide, vinyl formate, vinyl acetate, vinyl propionate, $C_1$–$C_4$-alkyl vinyl ethers, N-vinylpyridine, N-vinylpyrrolidone, N-vinylimidazole, ethylenically unsaturated $C_3$–$C_5$-carboxylic acids and esters, amides and nitriles thereof, sodium vinylsulfonate, vinyl chloride and vinylidene chloride in amounts of up to 25% by weight. For example, for the modification of natural starches, it is possible to use copolymers which contain, as polymerized units, 1) from 70 to 97% by weight of acrylamide and/or methacrylamide,
2) from 2 to 20% by weight of N-vinylimidazoline or N-vinyl-2-methylimidazoline and
3) from 1 to 10% by weight of N-vinylimidazole.

These copolymers are prepared by free radical copolymerization of the monomers 1), 2) and 3) by known polymerization methods. They have K values of from 80 to 150 (determined by H. Fikentscher in 5% strength aqueous sodium chloride solution at 25° C. and at a polymer concentration of 0.5% by weight).

Other suitable cationic polymers are copolymers of from 1 to 99, preferably from 30 to 70, mol % of acrylamide and/or methacrylamide and from 99 to 1, preferably from 70 to 30, mol % of dialkylaminoalkyl acrylates and/or methacrylates, for example copolymers of acrylamide and N,N-dimethylaminoethyl acrylate or N,N-diethylaminoethyl acrylate. Basic acrylates are preferably present in a form neutralized with acids or in quaternized form. The quaternization can be effected, for example, with methyl chloride or with dimethyl sulfate. The cationic polymers have K values of from 30 to 300, preferably from 100 to 180 (determined according to H. Fikentscher in 5% strength aqueous sodium chloride solution at 25° C. and at a polymer concentration of 0.5% by weight). At a pH of 4.5, they have a charge density of at least 4 meq/g of polyelectrolyte.

Copolymers of from 1 to 99, preferably from 30 to 70, mol % of acrylamide and/or methacrylamide and from 99 to 1, preferably from 70 to 30, mol % of dialkylaminoalkylacrylamide and/or dialkylaminoalkylmethacrylamide are also suitable. The basic acrylamides and methacrylamides are likewise preferably present in a form neutralized with acids or in a quaternized form. Examples are N-trimethylammoniumethylacrylamide chloride, N-trimethylammoniumethylmethacrylamide chloride, trimethylammoniumethylacrylamide methosulfate, trimethylammoniumethylmethacrylamide methosulfate, N-ethyldimethylammoniumethylacrylamide ethosulfate, N-ethyldimethylammoniumethylmethacrylamide ethosulfate, trimethylammoniumpropylacrylamide chloride, trimethylammoniumpropylmethacrylamide chloride, trimethylammoniumpropylacrylamide methosulfate, trimethylammoniumpropylmethacrylamide methosulfate and N-ethyldimethylammoniumpropylacrylamide ethosulfate. Trimethylammoniumpropylmethacrylamide chloride is preferred.

Other suitable cationic polymers are polyallylamines. Polymers of this type are obtained by homopolymerization of allylamine, preferably in a form neutralized with acids or in quaternized form, or by copolymerization of allylamine with other monoethylenically unsaturated monomers, corresponding to the copolymers, described above, with N-vinylcarboxamides.

For the novel cationic modification of starch, for example, an aqueous suspension, of at least one starch type is heated with one or more of the cationic polymers to above the glutinization temperature of the natural or of the modified starches, for example to 90–180° C., preferably 115–145° C. At temperatures above the boiling point of water, the reaction is carried out under superatmospheric pressure, the reaction being effected in a manner such that not more than 10% by weight of the starch suffer a decrease in molecular weight. Aqueous suspensions of starch contain, for example, from 0.1 to 10, preferably from 2 to 6, parts by weight of starch per 100 parts by weight of water. For example, from 0.5 to 10 parts by weight of at least one cationic polymer are used for 100 parts by weight of starch. Preferred cationic polymers are partially or completely hydrolyzed homo- or copolymers of N-vinylformamide, polyethyleneimines, ethyleneimine-grafted and crosslinked polyamidoamines and/or polydiallyldimethylammonium chlorides.

When the aqueous starch suspensions are heated in the presence of cationic polymers, the starch is initially digested. Starch digestion is understood as meaning the conversion of the solid starch grains into a water-soluble form, superstructures (helix formation, intramolecular hydrogen bridges, etc.) being eliminated without the amylose and/or amylopectin units of which the starch is composed being degraded to oligosaccharides or glucose. The aqueous starch suspensions which contain cationic polymer in dissolved form are heated to above the glutinization temperature of the starches in the reaction. In the novel process, at least 90, preferably >95% by weight of the starch used is digested and is modified with a cationic polymer. The starch dissolves to form a clear solution. After the reaction of the starch, preferably no unconverted starch can be filtered off from the reaction solution with the use of a cellulose acetate membrane having a pore diameter of 1.2 $\mu$m.

The reaction is preferably carried out at superatmospheric pressure. This is usually the pressure which the reaction medium develops at above the boiling points [sic] of water, for example at from 115 to 180° C. It is, for example, from 1 to 10, preferably from 1.2 to 7.9, bar. During the reaction, the reaction mixture is subjected to shearing. If the reaction is carried out in a stirred autoclave, the reaction mixture is stirred, for example, at from 100 to 2,000, preferably from 200 to 1,000, revolutions per minute. The reaction can be carried out in virtually any apparatus in which starch is digested in industry, for example in a jet digester. The residence times of the reaction mixture at the abovementioned temperatures of from 115 to 180° C. are, for example, from 0.1 second to 1 hour, preferably from 0.5 seconds to 30 minutes.

Under these conditions, at least 90% of the starch used are digested and modified. Preferably, less than 5% by weight of the starch are degraded.

The natural starch types can also be subjected to pretreatment, for example, oxidatively, hydrolytically or enzymatically degraded or chemically modified. Here too, the waxy starches, such as waxy potato starch (seed corn starch), are of particular interest.

For example, at a solids concentration of 3.5% by weight, the reaction products thus obtainable have a viscosity of from 50 to 10,000, preferably 80 to 4,000, mPa.s, measured in a Brookfield viscosimeter at 20 revolutions per minute and at 20° C. The pH of the reaction mixtures is, for example, from 2.0 to 9.0, preferably from 2.5 to 8.

The starches thus obtainable and modified with cationic polymers are added as dry strength agents to the paper stock in amounts of, for example, from 0.5 to 10, preferably from 0.5 to 3.5, particularly preferably from 1.2 to 2.5%, by weight, based on dry paper stock. According to the invention, a cationic polymer is additionally metered into the paper stock as a retention aid for the starches described above, such as cationic starch, preferably those starches which were modified with a polymer, anionic and/or amphoteric starches. Preferably, the dry strength agents are first metered in, followed by the retention aids. However, it is also possible to add dry strength agents and retention aids simultaneously to the paper stock, the dry strength agents and retention aids being metered in separately from one another. It is also possible to meter a mixture of dry strength agent and retention aid into the paper [sic]. Such a mixture can be prepared, for example, by adding the retention aid to the digested starch after cooling to 50° C. or below. However, the retention aid can also be added to the paper stock before addition of the modified starch. This sequence of addition is used, for example, in the processing of paper stocks having a high interfering substance content.

All cationic polymers which have been described above for the cationic modification of natural starch may be used as cationic polymers which are suitable as retention aids for starch, i.e.

- polymers containing vinylamine units
- polyethyleneimines
- crosslinked polyamidoamines
- ethyleneimine-grafted and crosslinked polyamidoamines
- polydiallyldimethylammonium chlorides
- polymers containing N-vinylimidazoline units
- polymers containing dialkylaminoalkyl acrylate or dialkylaminoalkyl methacrylate
- polymers containing dialkylaminoalkylacrylamide units or dialkylaminoalkylmethacrylamide units and
- polyallylamines.

Condensates of dimethylamine and epichlorohydrin, condensates of dimethylamine and dichloroalkanes, such as dichloroethane or dichloropropane, and condensates of dichloroethane and ammonia are also suitable.

In a preferred embodiment of the novel process, the cationic starch is used in combination with cationic polymers which contain vinylamine units and which have K values of at least 30 (determined according to H. Fikentscher in aqueous solution at a polymer concentration of 0.5% by weight, at 25° C. and at a pH of 7).

A preferably used dry strength agent is cationic starch which is obtainable by reacting 100 parts by weight of a natural, cationic, anionic and/or amphoteric starch with from 0.5 to 10 parts by weight of a polymer containing vinylamine units and having a K value of from 60 to 150 at above the glutinization temperature of the starch. Examples of preferably used polymers containing vinylamine units are hydrolyzed homo- and copolymers of N-vinylformamide having a degree of hydrolysis of at least 60%. These homo- and copolymers are not only added for cationization of starch but are also added to the paper stock as retention aids for the cationically modified starches.

The hydrolyzed homo- and copolymers of N-vinylformamide which are suitable as retention aids for starch can in general have a degree of hydrolysis of from 1 to 100%.

Other preferred cationic starches are obtainable, for example, by reacting 100 parts by weight of a natural, cationic, anionic and/or amphoteric starch with from 0.5 to 10 parts by weight of polydiallyldimethylammonium chloride water-soluble polyamidoamines crosslinked with epichlorohydrin water-soluble, ethyleneimine-grafted polyamidoamines crosslinked with bischlorohydrin ethers of polyalkylene glycols and/or water-soluble polyethyleneimines and water-soluble crosslinked polyethyleneimines at from above the glutinization temperature of the starches to 180° C.

Preferably used commercial cationic starches have, for example, a degree of substitution D.S. of up to 0.15. The starches to be used as dry strength agents are employed in amounts of from 0.5 to 10, preferably from 1 to 5%, by weight, based on dry paper stock. The drainage of the paper stock is always carried out, according to the invention, in the presence of at least one retention aid for starch, the retention aids being used in amounts of from 0.01 to 0.3% by weight, based on dry paper stock. This results in considerably improved retention of the starch and an increase in the drainage rate of the paper stock on the paper machine in comparison with the known processes.

Microparticle systems may also be used as retention aids for starch, a high molecular weight cationic synthetic polymer being added to the paper stock, the macroflocks formed being broken up by shearing the paper stock and bentonite then being added. This process is disclosed, for example, in EP-A-0 335 575. For such a microparticle system, for example, a mixture of a polymer containing vinylamine units, for example polyvinylamine, and a cationic polyacrylamide, for example a copolymer of acrylamide, and dimethylaminoethyl acrylate methochloride, may be used as cationic polymers and bentonite may be added after the shearing stage. Further preferred combinations of cationic polymers as retention aids for starches are mixtures of polymers containing vinylamine units and ethyleneimine-grafted crosslinked polyamidoamines and mixtures of polymers containing vinylamine units with polydiallyldimethylammonium chlorides.

In the examples which follow, percentages are by weight unless stated otherwise. K values are determined according to H. Fikentscher, Cellulose-Chemie, 13 (1932), 58–64 and 71–74, at 25° C. in aqueous solution at a polymer concentration of 0.5% by weight.

EXAMPLES

The following cationic polymers were used:

Polymer 1:

Polyamidoamine obtained from adipic acid and diethylenetriamine, grafted with ethyleneimine and then crosslinked with polyethyleneglycol dichlorohydrin ether according to Example 3 of DE-B-2 434 816.

Polymer 2:

Hydrolyzed polyvinylformamide having a K value of 90 and a degree of hydrolysis of 95 mol %.

Polymer 3:

Hydrolyzed polyvinylformamide having a K value of 90 and a degree of hydrolysis of 75 mol %.

Polymer 4:

Hydrolyzed polyvinylformamide having a K value of 90 and a degree of hydrolysis of 50 mol %.

Strength Agent 1

An aqueous suspension of natural potato starch was continuously digested in a laboratory jet digester from Werkstättenbau GmbH at 130° C. and 2.3 bar in the presence of 1.5% of polymer 2.

Examples 1 to 4

A paper stock having a consistency of 7.6 g/l was prepared from a beaten prepared commercial corrugated raw material based on waste paper. The pH of the paper stock was 8.0. To determine the starch retention, the amounts of strength agent 1 and of polymers 1–4 stated in Table 1 were added in succession in each case to samples of this paper stock. After thorough mixing of the paper stock with the additives, filtration with suction was carried out and the starch content was determined from the absorbance measurement of the starch-iodine complex. The results obtained are shown in Table 1. A further part of the paper stock was drained with the aid of a Schopper-Riegler apparatus after metering in the strength agent 1 and the respective polymers stated in Table 1. The drainage time was determined according to DIN ISO 5267 for 700 ml of filtrate. The results are shown in Table 1.

Comparative Example 1

Example 1 was repeated, except that only strength agent 1 in an amount of 2%, based on dry paper stock, was metered into the paper stock. The starch content of the filtrate and the drainage time are shown in Table 1.

TABLE 1

| Example | Addition to paper stock, based on dry paper stock | Starch content in filtrate [mg/l] | Drainage time [sec/700 ml] |
|---|---|---|---|
| 1 | 2% of strength agent 1 + 0.08% of polymer 1 | 38 | 92 |
| 2 | 2% of strength agent 1 + 0.08% of polymer 2 | 34 | 49 |
| 3 | 2% of strength agent 1 + 0.08% of polymer 3 | 30 | 55 |
| 4 | 2% of strength agent 1 + 0.08% of polymer 4 | 30 | 67 |

TABLE 1-continued

| | Addition to paper stock, based on dry paper stock | Starch content in filtrate [mg/l] | Drainage time [sec/700 ml] |
|---|---|---|---|
| Comparative Example | | | |
| 1 | 2% of strength agent 1 | 50 | 136 |

Example 5

First 2% of strength agent 1 and then 0.08% of polymer 3 as a retention aid for cationic starch were added to a beaten prepared commercial corrugated raw material based on waste paper and having a consistency of 0.76%. After the addition of strength agent and polymer, the paper stock was thoroughly mixed in each case. A part of this paper stock was filtered with suction. The COD and the starch retention of the filtrate were determined by enzymatic degradation to glucose by means of HPLC. The other part of the paper stock was used to determine the drainage time for 500 ml of filtrate with the aid of a Schopper-Riegler apparatus. The results are shown in Table 2.

Comparative Examples 2 to 4

Example 5 was repeated with the changes shown in Table 2. The results are shown in Table 2.

TABLE 2

| | Addition to paper stock, based on dry paper stock | COD [$mgO_2/l$] | Starch retention (enzymatic method) | Drainage time [sec/500 ml] |
|---|---|---|---|---|
| Example | | | | |
| 5 | 2% of strength agent 2 + 0.08% of polymer 3 | 134 | 93 | 20 |
| Comparative Example | | | | |
| 2 | 2% of strength agent 1 | 313 | 43 | 72 |
| 3 | 2% of commercial cationic starch D.S. 0.035 | 162 | 92 | 78 |
| 4 | — | 135 | | 68 |

Example 6

2% of strength agent 2 and 0.08% of polymer 3 were added in succession to a beaten prepared commercial corrugated raw material based on waste paper and having a consistency of 0.76%. After thorough mixing, paper sheets having a basis weight of 120 g per $m^2$ were produced on a Rapid Köthen sheet former. The sheets were tested for their dry strength, this being done by testing the dry breaking length according to DIN ISO 1924, dry bursting pressure according to DIN ISO 2758 and flat crush resistance CMT according to DIN EN 23035 (according to ISO 3035). The results are shown in Table 3.

Comparative Examples 5 to 7

Firstly, Example 6 was repeated with the changes shown in Table 3, but in the absence of polymer 3 (Comparative Example 5). In further tests, commercial cationic starch was used (Comparative Example 6) and the zero value was determined (Comparative Example 7). The results are shown in Table 3.

TABLE 3

| | Addition to paper stock, based on dry paper stock | Dry breaking length [m] | Dry bursting pressure [kPa] | CMT [N] |
|---|---|---|---|---|
| Example | | | | |
| 6 | 2% of strength agent 1 + 0.08% of polymer 3 | 4433 | 296 | 209 |
| Comparative Example | | | | |
| 5 | 2% of strength agent 1 | 4353 | 278 | 190 |
| 6 | 2% of commercial cationic starch D.S. 0.035 | 4488 | 296 | 194 |
| 7 | — | 3757 | 241 | 160 |

Polymer 5:

Hydrolyzed poly-N-vinylformamide having a K value of 90 and a degree of hydrolysis of 30%.

Polymer 6:

Commercially available modified PEI having a charge density of 14.7 at pH 4.5 or 10.8 at pH 7 and a mean molecular weight of about 700,000 D.

Polymer 7:

High-molecular-weight, cationic polyacrylamide having a charge density of 1.7 at pH 4.5 and a mean molecular weight of 8.5 million D.

Example 7

2% of strength agent 1, 0.245% of polymer 6 and 0.02% of polymer 7 were added in succession to a colored paper stock based on waste paper and having a COD value of 8000 mg of oxygen/l and a consistency of 1%. After thorough mixing, paper sheets having a basis weight of about 110 g/$m^2$ were produced on a Rapid Köthen sheet former. The sheets were tested for their dry strength, this being done by testing the strip crush resistance (SCT) value according to DIN 54518 (ISO 9895), dry bursting pressure according to DIN ISO 2758 and flat crush resistance CMT according to DIN EN 23035 (ISO 3035). The results are shown in Table 4.

Example 8

2% of strength agent 1, 0.12% of polymer 2 and 0.02% of polymer 7 were added successively to a paper stock based on waste paper and having a COD value of 8000 mg of oxygen/l and a consistency of 1%. After thorough mixing, paper sheets having a basis weight of about 110 g/$m^2$ were produced on a Rapid Köthen sheet former. The sheets were tested for their dry strength by the methods indicated in Example 7. The results are shown in Table 4.

Example 9

2% of strength agent 1, 0.12% of polymer 3 and 0.02% of polymer 7 were added successively to a paper stock based on waste paper and having a COD value of 8000 mg of oxygen/l and a consistency of 1%. After thorough mixing, paper sheets having a basis weight of about 110 g/$m^2$ were produced on a Rapid Köthen sheet former. The sheets were tested for their dry strength by the methods indicated in Example 7. The results are shown in Table 4.

Example 10

2% of strength agent 1, 0.13% of polymer 4 and 0.02% of polymer 7 were added successively to a paper stock based on waste paper and having a COD value of 8000 mg of oxygen/l and a consistency of 1%. After thorough mixing, paper sheets having a basis weight of about 110 g/m$^2$ were produced on a Rapid Köthen sheet former. The sheets were tested for their dry strength by the methods indicated in Example 7. The results are shown in Table 4.

Example 11

2% of strength agent 1, 0.13% of polymer 5 and 0.02% of polymer 7 were added successively to a paper stock based on waste paper and having a COD value of 8000 mg of oxygen/l and a consistency of 1%. After thorough mixing, paper sheets having a basis weight of about 110 g/m$^2$ were produced on a Rapid Köthen sheet former. The sheets were tested for their dry strength by the methods indicated in Example 7. The results are shown in Table 4.

Comparative Example 8

2% of strength agent 1 and 0.02% of polymer 7 were added successively to a paper stock based on waste paper and having a COD value of 8000 mg of oxygen/l and a consistency of 1%. After thorough mixing, paper sheets having a basis weight of about 110 g/m$^2$ were produced on a Rapid Köthen sheet former. The sheets were tested for their dry strength by the methods indicated in Example 7. The results are shown in Table 4.

TABLE 4

| Example | Addition to paper stock, based on dry paper stock | COD value of the filtrate (mg of $O_2$/l) | Starch retention (enzymatic method) in % of the starch available | Strip crush resistance on 110 g/m$^2$ | Dry bursting pressure (kPa) on 110 g/m$^2$ | CMT (N) on 110 g/m$^2$ |
|---|---|---|---|---|---|---|
| 7 | 2% strength agent 1, 0.245% polymer 6 and 0.02% polymer 7 | 7480 | 92 | 3.18 | 276 | 181 |
| 8 | 2% strength agent 1, 0.12% polymer 2 and 0.02% polymer 7 | 7680 | 87 | 2.87 | 295 | 172 |
| 9 | 2% strength agent 1, 0.12% polymer 3 and 0.02% polymer 7 | 6860 | 91 | 2.86 | 280 | 174 |
| 10 | 2% strength agent 1, 0.13% polymer 4 and 0.02% polymer 7 | 7020 | 86 | 2.81 | 289 | 177 |
| 11 | 2% strength agent 1, 0.13% polymer 5 and 0.02% polymer 7 | 7010 | 94 | 2.83 | 296 | 166 |
| Comparative Example 8 | 2% strength agent 1 and 0.02% polymer 7 | 7180 | 66 | 2.77 | 282 | 172 |

We claim:

1. A process for the production of paper, board and cardboard comprising addition of cationic, anionic or amphoteric starch as a dry strength agent to paper stock and drainage of the paper stock in the presence of retention aids with sheet formation, wherein one of the following is used as a retention aid for starch:

polymers containing vinylamine units
polyethyleneimines
crosslinked polyamidoamines
ethyleneimine-grafted and crosslinked polyamidoamines
polydiallyldimethylammonium chlorides
polymers containing N-vinylimidazoline units
polymers containing dialkylaminoalkyl acrylate or dialkylaminoalkyl methacrylate
polymers containing dialkylaminoalkylacrylamide units or dialkylaminoalkylmethacrylamide units and
polyallylamines.

2. A process as claimed in claim 1, wherein a cationic starch is used in combination with cationic polymers which contain vinylamine units and have K values of at least 30 (determined according to H. Fikentscher in aqueous solution at a polymer concentration of 0.5% by weight, at 25° C. and at a pH of 7).

3. A process as claimed in claim 1, wherein a cationic starch which is obtainable by reacting 100 parts by weight of a natural, cationic, anionic or amphoteric starch with from 0.5 to 10 parts by weight of a polymer containing vinylamine units and having a K value of from 60 to 150 at above the glutinization temperature of the starch is used.

4. A process as claimed in claim 3, wherein hydrolyzed homo- or copolymers of N-vinylformamide having a degree of hydrolysis of at least 60% are used as the polymers containing vinylamine units.

5. A process as claimed in claim 1, wherein hydrolyzed homo- or copolymers of N-vinylformamide having a degree of hydrolysis of from 1 to 100% are used as retention aids for starch.

6. A process as claimed in claim 1, wherein a cationic starch having a degree of substitution D.S. of up to 0.15 is used.

7. A process as claimed in claim 1, wherein the dry strength agents are used in amounts of from 0.5 to 10% by weight, based on dry paper stock.

8. A process as claimed in claim 1, wherein the dry strength agents are used in amounts of from 1 to 5% by weight, based on dry paper stock.

9. A process as claimed in claim 1, wherein the retention aids for starch are used in amounts of from 0.01 to 0.3% by weight, based on dry paper stock.

10. A process as claimed in claim 1, wherein a cationic starch which is obtainable by reacting 100 parts by weight of a natural, cationic, anionic or amphoteric starch with from 0.5 to 10 parts by weight of polydiallyl-dimethylammonium chloride, water-soluble polyamidoamines crosslinked with epichlorohydrin water-soluble ethyleneimine-grafted polyamidoamines crosslinked with bischlorohydrin ethers of polyalkylene glycols or water-soluble polyethyleneimines and water-soluble crosslinked polyethyleneimines at from above the glutinization temperature of the starch to 180° C. is used.

11. The process of claim 1, wherein said starch is cationic.

12. The process of claim 1, wherein said starch is anionic.

13. The process of claim 1, wherein said starch is amphoteric.

14. A method for increasing the retention of dry strength agents comprising cationic, anionic or amphoteric starch in the production of paper, board or cardboard, comprising carrying out said production in the presence of a cationic polymeric retention aid selected from the group consisting of polymers containing vinylamine units polyethyleneimines crosslinked polyamidoamines ethyleneimine-grafted and crosslinked polyamidoamines polydiallyldimethylammonium chlorides polymers containing N-vinylimidazoline units polymers containing dialkylaminoalkyl acrylate or dialkylaminoalkyl methacrylate polymers containing dialkylaminoalkylacrylamide units or dialkylaminoalkylmethacrylamide units and polyallylamines.

15. The method as claimed claim 14, in wherein hydrolyzed homo- or copolymers of N-vinylformamide having a degree of hydrolysis of from 1 to 100% and K value of at least 30 (determined according to H. Fikentscher in aqueous solution at a polymer concentration of 0.5% by weight, at 25° C. and at a pH of 7) are used as retention aids in amounts of from 0.01 to 0.3% by weight.

16. The method of claim 14, wherein said starch is cationic.

17. The method of claim 14, wherein said starch is anionic.

18. The method of claim 14, wherein said starch is amphoteric.

* * * * *